US007819553B2

(12) United States Patent
Lexso

(10) Patent No.: US 7,819,553 B2
(45) Date of Patent: Oct. 26, 2010

(54) MODULAR LIGHT STRAND KIT

(76) Inventor: John C. Lexso, 3459 Warren Ravenna Rd., Newton Falls, OH (US) 44444

( * ) Notice: Subject to any disclaimer, the term of this patent is extended or adjusted under 35 U.S.C. 154(b) by 128 days.

(21) Appl. No.: 12/222,720

(22) Filed: Aug. 14, 2008

(65) Prior Publication Data

US 2010/0039803 A1 Feb. 18, 2010

(51) Int. Cl.
*F21V 21/00* (2006.01)
*H01R 13/62* (2006.01)

(52) U.S. Cl. ..... 362/249.14; 362/249.07; 362/806; 349/660; 349/679

(58) Field of Classification Search ..... 362/249.06, 362/249.07, 249.14, 806; 439/505, 679, 439/660

See application file for complete search history.

(56) References Cited

U.S. PATENT DOCUMENTS 3,504,169 A * 3/1970 Freeburger ..... 362/249.01
4,675,575 A 6/1987 Smith et al.
4,994,944 A * 2/1991 Vernondier ..... 362/239
5,816,849 A * 10/1998 Schmidt ..... 439/505
6,540,549 B2 * 4/2003 Rupert ..... 439/502
6,688,754 B1 2/2004 Wu
2005/0092517 A1 5/2005 Fan
2005/0180162 A1 8/2005 Fan
2006/0018110 A1 1/2006 Chien
2006/0158883 A1 7/2006 Wu
2006/0227549 A1 10/2006 Cheng
2007/0091606 A1 4/2007 Reed

* cited by examiner

*Primary Examiner*—Ali Alavi
(74) *Attorney, Agent, or Firm*—Richard C. Litman

(57) ABSTRACT

The modular light strand kit has decorative light strand segments having a plurality of predetermined lengths to achieve a customized length for a desired application. Lighted strand segments have varying lengths and number of lights per strand segment. Strand length is customized by plugging individual strand segments together. Segments are mixed and matched to obtain a customized number of lights. Each strand segment has a male locking waterproof plug on one end and, at the other end, a female locking waterproof receptacle in the same covering that houses the last light on the strand. Lightless wire segments having different predetermined lengths are included and have the same male locking waterproof plug on one end and a straight locking waterproof female plug on the other end. The lightless segments function as spacers where lights are not desired. A common mains adapter plug provides power to all strands in use.

12 Claims, 4 Drawing Sheets

MODULAR LIGHT STRAND KIT

BACKGROUND OF THE INVENTION

1. Field of the Invention

The present invention relates to lighting devices and more particularly to an ornamental lighting system which allows the user to adjustably determine the length for a specific application and for providing a plurality of sections which easily removable for repair or maintenance.

2. Description of the Related Art

The use of ornamental lighting strings is known in the prior art, however there remains at least one problem associated with the known lighting string devices in that they do not provide an adjustable ornamental lighting system having the specific features disclosed in the present invention.

Thus, a modular light strand kit solving the aforementioned problems is desired.

SUMMARY OF THE INVENTION

The modular light strand kit is comprised of decorative light strand segments having a plurality of predetermined lengths to achieve a customized length for a desired application. Lighted strand segments have varying lengths and number of lights per strand segment.

Strand length is customized by plugging individual strand segments together. Segments are mixed and matched to obtain a customized number of lights. Each strand segment has a male locking waterproof plug on one end and, at the other end, a female locking waterproof receptacle in the same covering that houses the last light on the strand.

Lightless wire segments having different predetermined lengths are included and have the same male locking waterproof plug on one end and a straight locking waterproof female plug on the other end. The lightless segments function as spacers where lights are not desired. A common mains adapter plug provides power to all strands in use.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

As shown in FIGS. 1-7, the present invention is comprised of strands of decorative lights having a plurality of predetermined lengths to achieve a customized length for a desired application. Segments of light strands have varying lengths and number of lights. The shortest segment light strand 10*a* includes one light L. The longest segment light strand 10*e* is comprised of five lights L. Intermediate length segments such as 2 light segment 10*b*, 3 light segment 10*c*, and 4 light segment 10*d* are also provided in the kit.

Strand length is customized by plugging the strand segments together. Strand segments are mixed and matched in any combination to obtain a customized number of lights and total strand length. Each strand segment has a male locking water-resistant plug 15*a* on one end and, at the other end, a female locking water-resistant receptacle 15*b*, the female locking water-resistant receptacle 15*b* being housed in the same covering 14 that houses the last light on the strand. The portion of cover 14 that houses the lighting fixture extends away from the wire segment at approximately ninety degrees, and the portion of cover 14 that surrounds the receptacle 15*b* extends in substantially axial alignment away from the wire segment.

The kit includes lightless wire segments 40*a* and 40*b* having different predetermined lengths, the same male locking water-resistant plug 15*a* on one end and a straight (axial without the light fixture housing component) locking water-resistant female plug 15*c* on the other end. The lightless segments 40*a* and 40*b* function as spacers between windows or anywhere lights are not desired. A common mains adapter plug 70 provides power to all strands in use. Preferably the mains adapter plug 70 has a built-in receptacle for the strand plugs thereby obviating the necessity for a pigtail at the end of the adapter plug.

Figure 1:
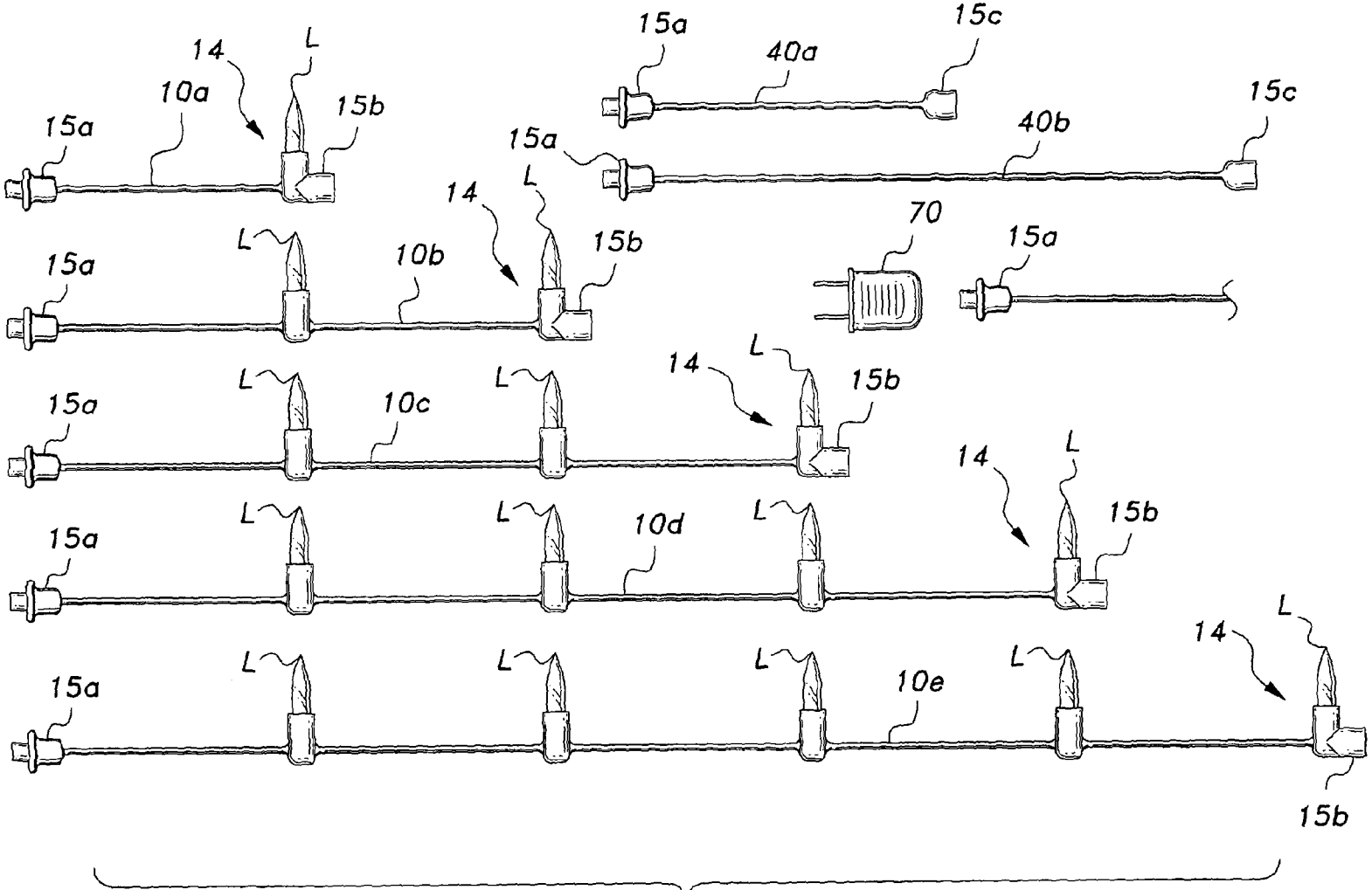
FIG. 1 is a side view of the modular light strand kit according to the present invention.
Figure 2:
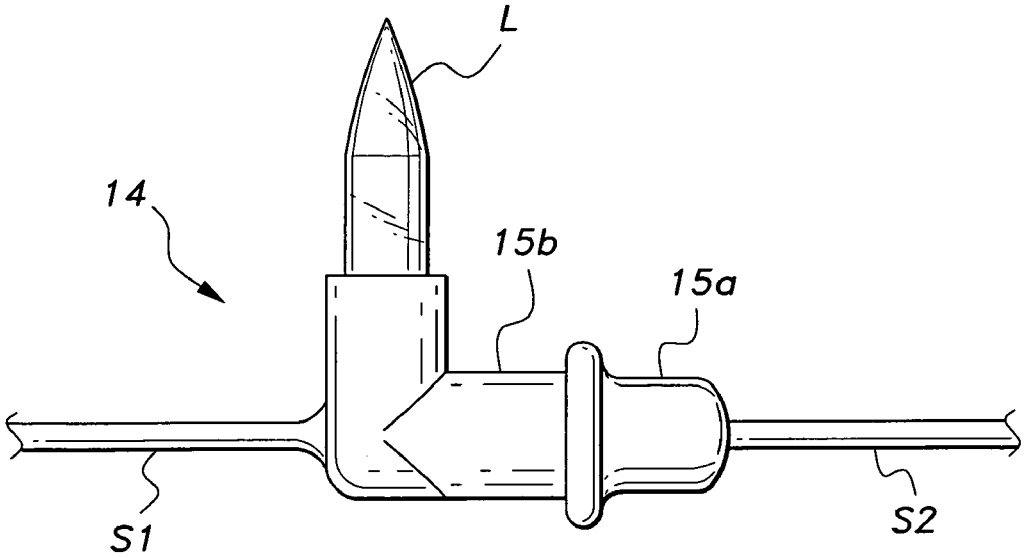
FIG. 2 is a side view of the modular light strand kit showing two exemplary strands being connected according to the present invention.
Figure 3:
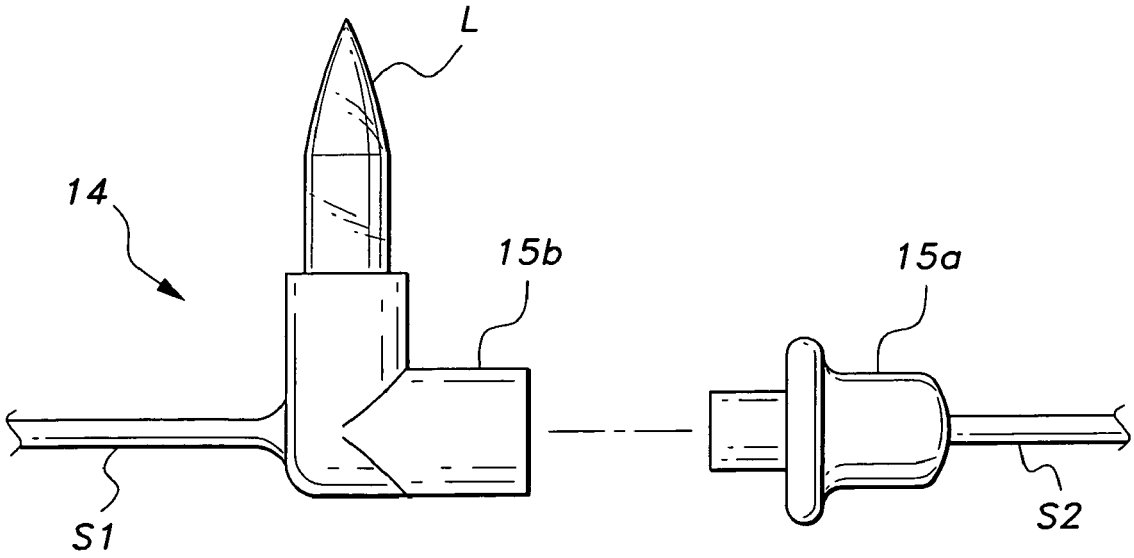
FIG. 3 is a side view of the modular light strand kit showing two exemplary strands being disconnected according to the present invention.
Figure 4:
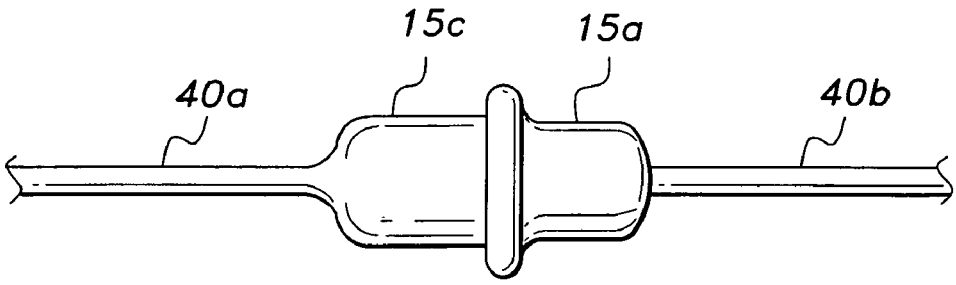
FIG. 4 is a side view of two exemplary extension cords of the modular light strand kit showing the two exemplary extension cords being connected according to the present invention.
Figure 5:
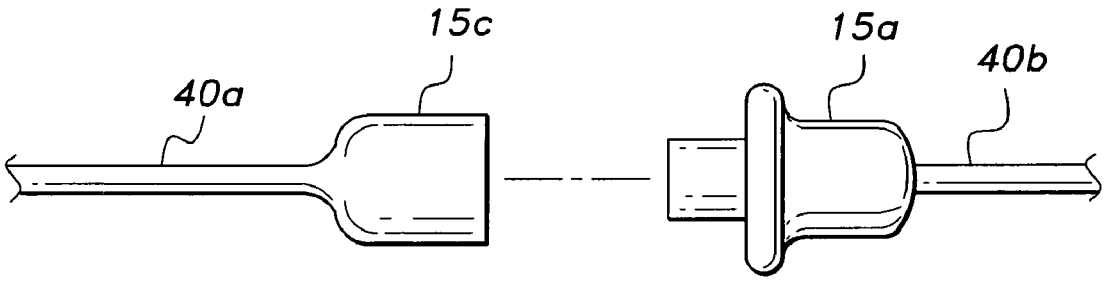
FIG. 5 is a side view of two exemplary extension cords of the modular light strand kit showing the two exemplary extension cords being disconnected according to the present invention.
Figure 6:
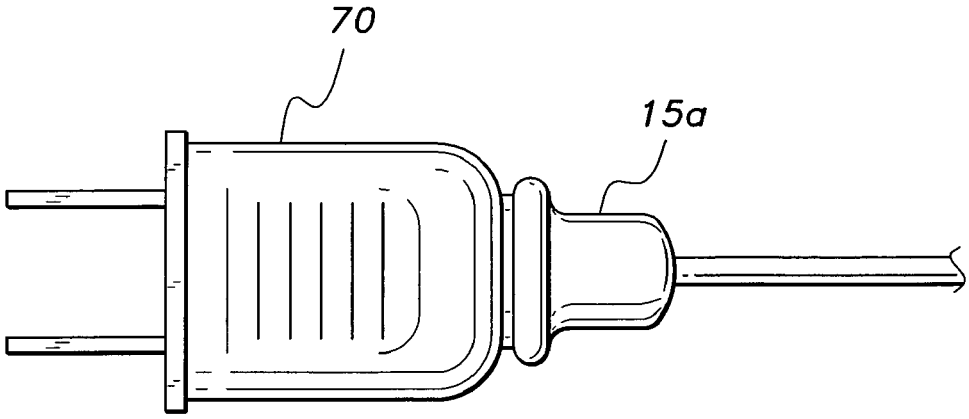
FIG. 6 illustrates a side view of a mains plug adapter being connected to a connector plug of the modular light strand kit according to the present invention.
Figure 7:
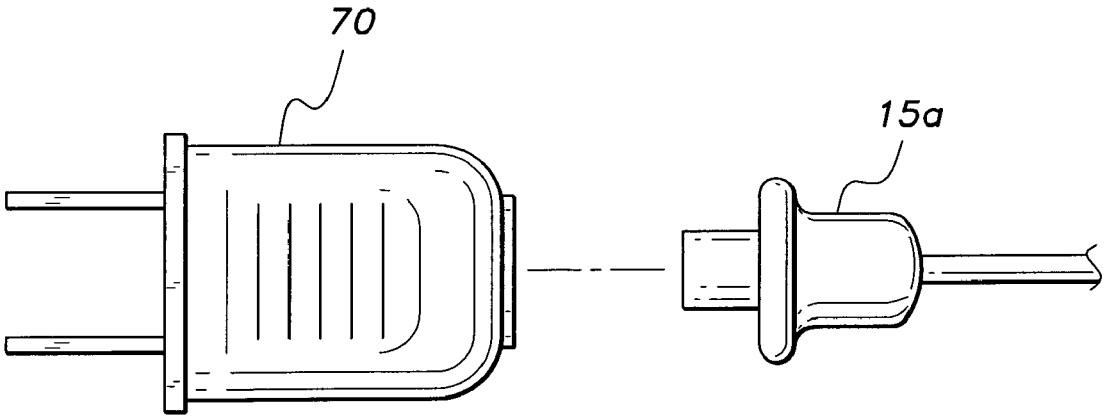
FIG. 7 presents a side view of a mains plug adapter being disconnected from a connector plug of the modular light strand kit according to the present invention.

As most clearly shown in FIG. 2, a first strand S1 may be connected to a second strand S2 via connection of integrally housed receptacle 15*b* of the first strand S1 with the plug 15*a* of the second strand S2. The plug 15*a* and receptacle 15*b* lock into place and can only be placed in the separated state shown in FIG. 3 by mechanically unlocking the plug 15*a* and receptacle 15*b* from each other. As known by persons having ordinary skill in the art, any one or combination of a variety of locking mechanisms for the plug and receptacle may be employed in this invention. As shown in FIGS. 4 and 5, the extension segments 40*a* and 40*b* may be locked together or disconnected in a similar fashion. Moreover, as shown in FIGS. 6-7, a segment plug 15*a* similarly removably lockingly engages/disengages built in receptacled mains adapter 70. It should be understood that the lights L in the modular light strand kit may be pre-wired in a parallel configuration or in a series configuration depending on the electrical requirements of the lights used.

It is to be understood that the present invention is not limited to the embodiment described above, but encompasses any and all embodiments within the scope of the following claims.

I claim:

1. A modular light strand kit, comprising:

a plurality of elongated wire segments, each of the segments having:

an electrically conductive wire strand;

a plug at one end of the wire segment; and a receptacle at the other end of the wire segment, the plug and the receptacle of each of the segments being electrically connectable to the other wire segments in the plurality of wire segments;

a single light fixture disposed proximate to the end of at least one of the wire segments, the single light fixture being electrically connected to the conductive wire strand, the conductive wire strand having a first length dimension;

a cover housing the light fixture at the end of the wire segment, the electrical receptacle being surrounded by the cover;

a mains adapter plug removably connectable to the wire segment plug, the mains adapter plug being adapted for connecting to a mains voltage source to supply power to a chain of the electrically connected wire segments, whereby the light fixtures are energized; and additional lighting fixtures, the additional lighting fixtures being disposed between the plug and the end lighting fixture on the wire strand, length of the wire strand being extended to accommodate the additional lighting fixtures.

2. The modular light strand kit according to claim 1, wherein the portion of the cover housing the lighting fixture extends away from the wire segment at approximately ninety degrees, and the portion of the cover surrounding the receptacle extends in substantially axial alignment away from the wire segment.

3. The modular light strand kit according to claim 1, wherein the wire strand includes two lighting fixtures, the wire strand having a second length dimension.

4. The modular light strand kit according to claim 3, wherein the wire strand includes three lighting fixtures, the wire strand having a third length dimension.

5. The modular light strand kit according to claim 4, wherein the wire strand includes four lighting fixtures, the wire strand having a fourth length dimension.

6. The modular light strand kit according to claim 5, wherein the wire strand includes five lighting fixtures, the wire strand having a fifth length dimension.

7. The modular light strand kit according to claim 1, wherein the male plug removably locks into the female receptacle, both the plug and the receptacle being water resistant.

8. The modular light strand kit according to claim 1, wherein the wire segments without lighting fixtures are available in a plurality of predefined lengths.

9. The modular light strand kit according to claim 8, wherein the wire segments without lighting fixtures the predefined lengths correspond to the lengths of the wire strands having the lighting fixtures.

10. The modular light strand kit according to claim 1, wherein the lights in the kit are pre-wired in a series configuration.

11. The modular light strand kit according to claim 1, wherein the lights in the kit are pre-wired in a parallel configuration.

12. A modular light strand kit, comprising:

a plurality of elongated wire segments, each of the segments having:

an electrically conductive wire strand;

a plug at one end of the wire segment; and a receptacle at the other end of the wire segment, the plug and the receptacle of each of the segments being electrically connectable to the other wire segments in the plurality of wire segments;

a single light fixture disposed proximate to the end of at least one of the wire segments, the single light fixture being electrically connected to the conductive wire strand, the conductive wire strand having a first length dimension;

a cover housing the light fixture at the end of the wire segment, the electrical receptacle being surrounded by the cover, wherein the portion of the cover housing the lighting fixture extends away from the wire segment at approximately ninety degrees, and the portion of the cover surrounding the receptacle extends in substantially axial alignment away from the wire segment; and a mains adapter plug removably connectable to the wire segment plug, the mains adapter plug being adapted for connecting to a mains voltage source to supply power to a chain of the electrically connected wire segments, whereby the light fixtures are energized.

* * * * *